US006634154B1

(12) United States Patent
Palencar

(10) Patent No.: US 6,634,154 B1
(45) Date of Patent: Oct. 21, 2003

(54) PLASTIC POST

(75) Inventor: Joseph Palencar, Baltimore, MD (US)

(73) Assignee: Atlas Post and Column, Baltimore, MD (US)

( * ) Notice: Subject to any disclaimer, the term of this patent is extended or adjusted under 35 U.S.C. 154(b) by 0 days.

(21) Appl. No.: 10/004,621

(22) Filed: Nov. 1, 2001

(51) Int. Cl.[7] ..... E04C 3/30

(52) U.S. Cl. ..... 52/720.2; 52/309.1; 52/732.2; 52/736.1; 256/22; 256/65.01

(58) Field of Search ..... 52/720.2, 730.1, 52/731.2, 732.2, 736.1, 309.1, 736.3; 256/1, 19, 21, 22, 66, 65.01; 5/281; 249/51; D25/126, 130

(56) References Cited

U.S. PATENT DOCUMENTS 3,352,541 A * 11/1967 Thom ..... 256/21
3,490,190 A * 1/1970 See ..... 52/732.2
3,511,006 A * 5/1970 Medow ..... 52/301
3,915,434 A * 10/1975 Lister ..... 256/59
4,035,978 A * 7/1977 Bajorek et al. ..... 52/720.2
4,038,802 A * 8/1977 Bajorek et al. ..... 52/720.2
4,246,732 A 1/1981 Frehner
4,293,122 A * 10/1981 Coleman et al. ..... 256/69
4,722,514 A 2/1988 Pettit
4,858,891 A 8/1989 Boes
5,613,664 A 3/1997 Svalbe
5,620,136 A 4/1997 Erwin et al.
5,626,331 A 5/1997 Erwin
5,876,021 A 3/1999 Spence et al.
6,017,019 A 1/2000 Erwin
6,076,807 A * 6/2000 Spence ..... 256/1
6,126,148 A 10/2000 Lesenskyj
2001/0050361 A1 * 12/2001 Merrick ..... 256/1

* cited by examiner

*Primary Examiner*—Brian E. Glessner
(74) *Attorney, Agent, or Firm*—Young & Basile, P.C.

(57) ABSTRACT

A post is formed from a pair of molded elongate half members having an interior surface. The pair of the elongate members are connectable to each other to form a column structure having a hollow interior. At least one support member is integrally molded to each half member and extending into the hollow interior so that a support member from one half member is disposed between two adjacent support members from the other half member.

10 Claims, 3 Drawing Sheets

PLASTIC POST

BACKGROUND OF THE INVENTION

The present invention relates to a post made of moldable material.

Outdoor posts were traditionally made from wood for the use of fencing, decking and support columns. Because of environmental and conservation concerns, the availability of wood material has diminished, and as a result, the cost of wood has increased. Therefore other materials have been used as a substitute for wood.

One such product used is plastic material, which is less expensive, moldable to various shapes, and weather resistant. Although plastic material has many advantages over wood, a hollow post made of plastic material does not provide an adequate amount of strength for most uses. To alleviate this problem, many posts or railing made of plastic material incorporates a metal rod extending through the longitudinal length of the post. Although the center steel rod provides the necessary strength to the post or spindle, the insertion of the rod not the of the post requires added assembly time at the manufacturing site or at the construction site of a house, fencing, or deck, etc.

SUMMARY OF THE INVENTION

It is the intent of the invention to address the aforementioned concerns regarding the use of plastic for a post. The present invention provides a post comprising a column structure having a hollow interior wherein the column structure has a elongate first half member and a elongate second half member. Each half member is made of moldable material and connectable to each other for forming the column structure with a hollow interior. Each half member has integrally formed support members attached to inner surfaces and extending therefrom into the hollow interior.

Another aspect of the invention includes that a support member from one half member is disposed between two adjacent support members from the other half member when the first and second half members are joined together.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 2:
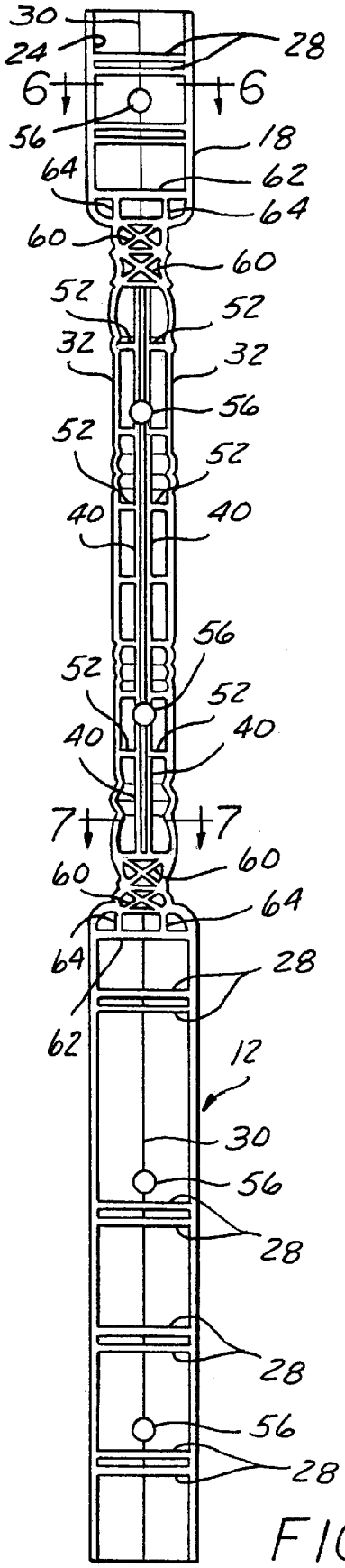
FIG. 2 is an elevational view of the interior of a first half member of the post of FIG. 1.
Figure 3:
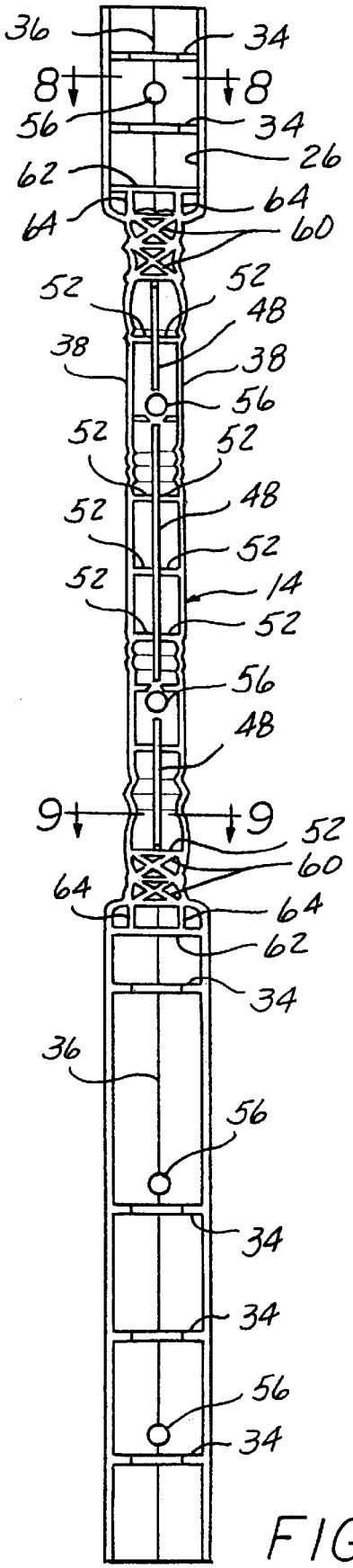
FIG. 3 is an elevational view of the interior of a second half member of the post of FIG. 1.

Looking at the FIGS. 1–9 the invention provides a post 10 constructed of a moldable material such as plastic. The post 10 is formed from two half members 12, 14. The exteriors of the half members 12, 14 are essentially identical. The interior of the half members 12, 14 have complementary portions which add strength and stability to the post 10. The interior surface 24 of the first half member 12 is shown in FIG. 2. The interior surface 26 of the second half member 14 is shown in FIG. 3. The two half members 12 and 14 are connected to each other along a longitudinal seam 16 formed by joining longitudinal edges 32 and 38 respectively. The post 10 can have a variety of exterior configurations to provide a decorative post for a particular application. As can be seen in the Figures, the post 10 can include any combination of rectangular cross-sectional portions 18 as well as circular cross-sectional portions 20. If rectangular cross-sectional portions 18 are included in the design, each half member 12 and 14 form a triangular configuration and are joined at seams 16. Each half member 12 and 14 of the circular cross-sectional portions 20 forms a semi-circular configuration. The two semi-circular configurations are joined at seams 16.

FIG. 2 shows the interior of elongate half member 12; and FIG. 3 shows the interior of elongate half member 14. Looking at the Figures, it can be seen that each elongate half member 12 and 14 has various molded support means within the respective interiors. Each support means is integrally molded to the interior surface 24 and 26 of its associated half member 12 and 14. The support means are provided in various configurations to prevent both vertical and lateral movement of the half members 12 and 14 when joined to form the post 10.

Figure 4:
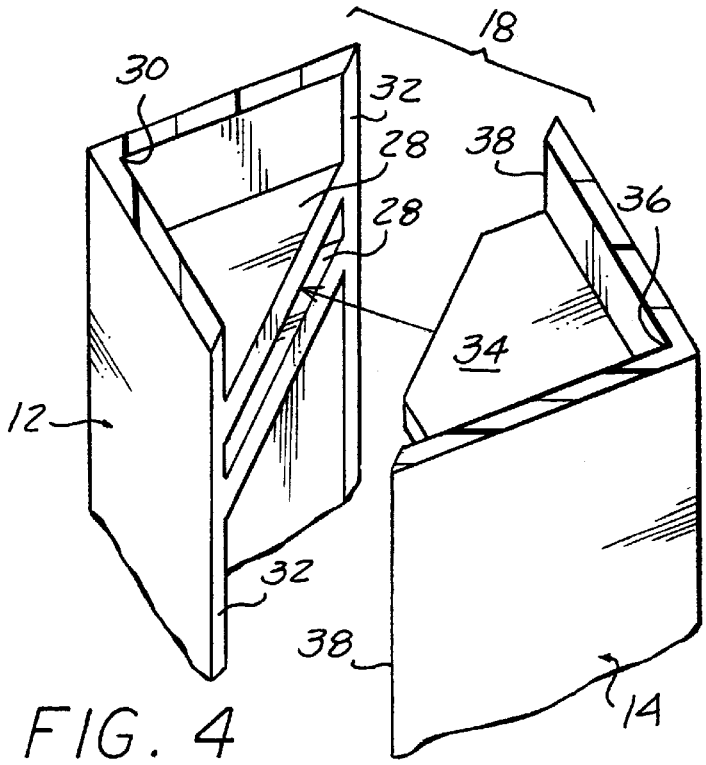
FIG. 4 is an exploded view of a portion of the two half members which form the post.

One configuration of the support means is shown in FIG. 4. FIG. 4 shows a rectangular cross-sectional portion 18 of the column structure or post 10. The rectangular cross-sectional portion 18 illustrates one configuration of support means for the post 10. One of the elongate half members 12 has a pair of planar shelves 28 extending from an interior corner 30 of half member 12. The pair of planar shelves 28 extend outwardly from the interior corner 30 to the exposed longitudinal edges 32 of the elongate half member 12. Elongate half member 14 has a single planar shelf 34 extending from an interior corner 36 of half member 14. The single planar shelf 34 extends from the interior corner 36 and beyond the longitudinal exposed edges 38 of half member 14. The pair of planar shelves 28 and the single planar shelf 34 are placed along the longitudinal length of the post 10 so that when the two half members 12 and 14 are joined together, the single planar shelf 34 is received between the two planar shelves 28. The thickness of single planar shelf 34 and the distance between the two planar shelves 28 are configured so that when the two half members 12 and 14 are joined together, the single planar shelf 34 fits snugly between the pair of planar shelves 28. The planar shelves 28 and 34 are preferably oriented parallel to the rectangular cross-section portions 18. The orientation and the snug fit of the planar shelves 28 and 34 prevent longitudinal or vertical shifting of the post 10 during assembly and in use.

Figure 1:
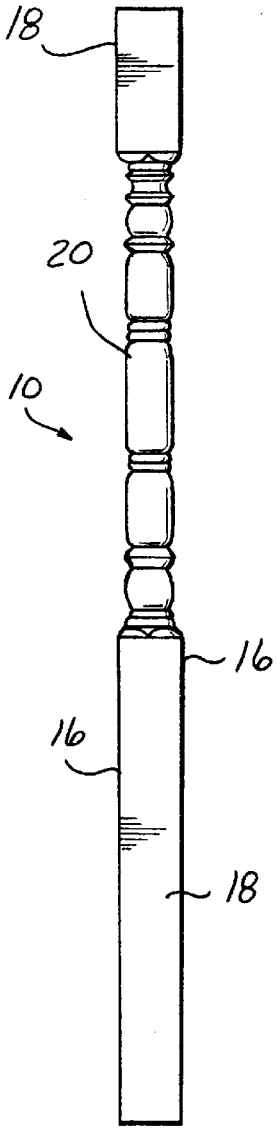
FIG. 1 is an elevational view of the post according to the present invention.
Figure 5:
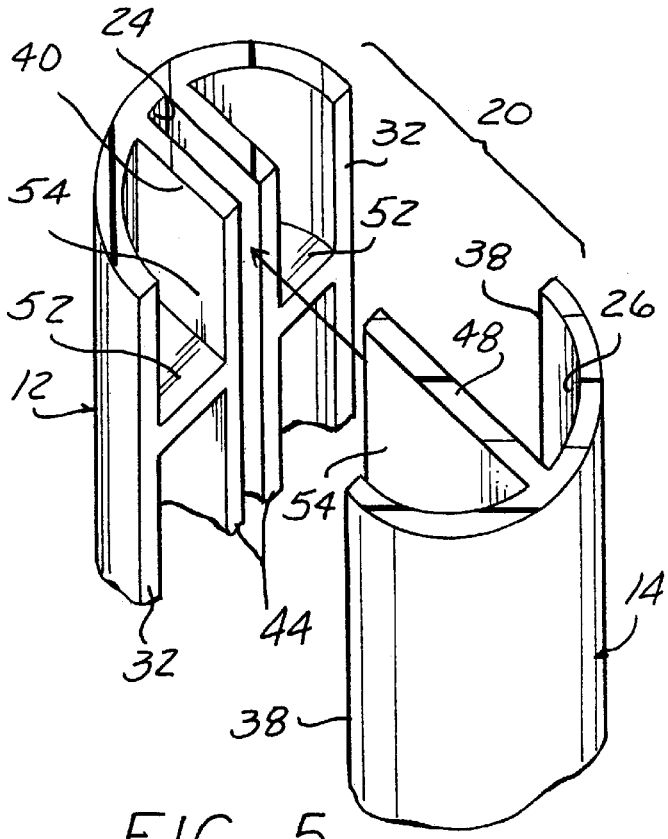
FIG. 5 is an exploded view of another portion of the two half members which form the post.

FIG. 5 shows another support means for the post 10 that is preferably located in a circular cross-sectional portion 20.

The support means illustrated in FIG. 5 includes a pair of vertical or longitudinally extending shelves 40 located in one elongate half member 12 of the circular cross-sectional portion 20. The pair of vertical or longitudinal shelves 40 extend from the interior inner surface 24 outwardly and terminate so that the exterior edges 44 of shelves 40 are on the same plane with the longitudinally exposed edges 32 of the elongate half member 12. The elongate half member 14 has a single vertical or longitudinally extending planar shelf 48 extending outwardly from the interior surface 26. The single vertical shelf 48 is positioned within elongate half member 14 so that it extends past the longitudinal exposed edges 38 of elongate half member 14. Vertical shelf 48 is centrally located within half member 14 and positioned so that when the half members 12 and 14 of the circular cross-sectional portion 20 are joined, the single vertical shelf 48 is received between the pair of vertical planar shelves 40. The distance between the pair of vertical planar shelves 40 and the thickness of the single vertical shelf 48 are configured for a snug fit of the single vertical shelf 48 between the pair of vertical planar shelves 40 to prevent lateral movement of the post 10 during assembly and in use. The longitudinal planar shelves 40 and 48 are preferably reinforced by horizontal support means 52 which connect the outer faces 54 of the vertical shelves 40 and 48 to the adjacent side of the interior surfaces 24 and 26 respectively of the circular cross-sectional portions 20. A plurality of the horizontal support means 52 may be spaced along the longitudinal length of the circular cross-sectional portions 20 of the post 10 as shown in FIGS. 2 and 3.

Figure 6:
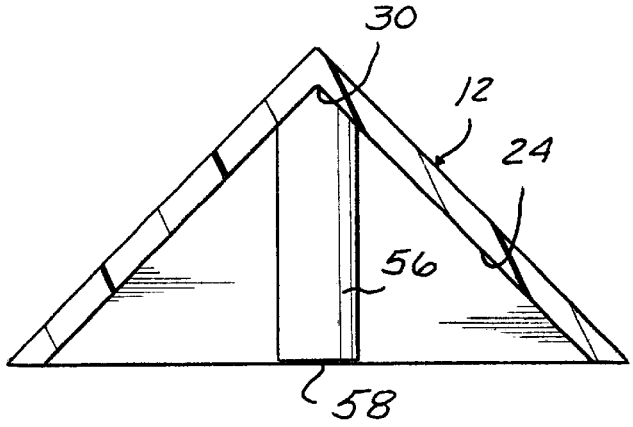
FIG. 6 is a sectional illustration of the first half member of the post of FIG. 2 taken along line 6—6.
Figure 7:
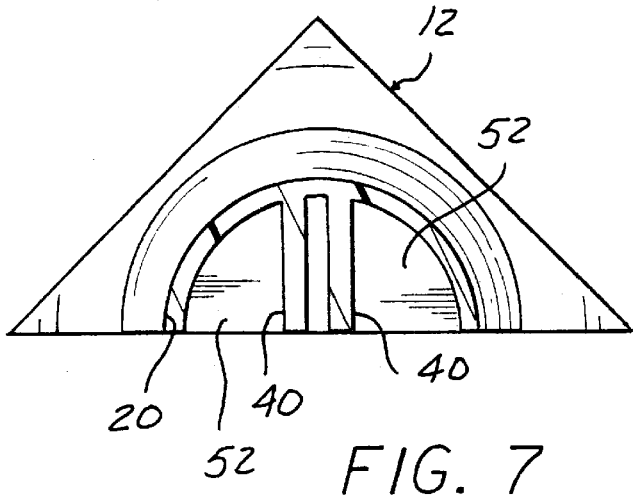
FIG. 7 is a sectional illustration of the first half member of the post of FIG. 2 taken along line 7—7.
Figure 8:
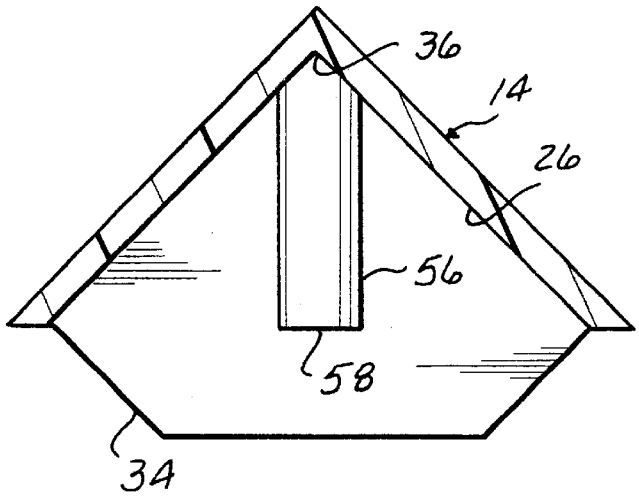
FIG. 8 is a sectional illustration of the second half member of the post of FIG. 3 taken along 8—8.
Figure 9:
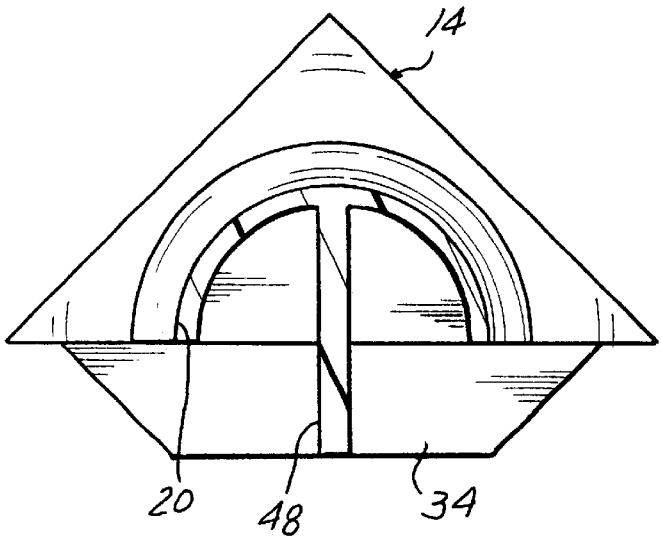
FIG. 9 is a sectional illustration of the second half member of the post of FIG. 3 taken along lines 9—9.

Another support means is shown in FIGS. 6 and 8. The support means includes circular rods 56 extending from opposing sides from each of the interior surfaces 24, 26 of elongate half members 12, 14 so that when the elongate half members 12 and 14 are joined, the circular rods 56 meet. An adhesive material (not shown) can be applied to the ends 58 of the circular rods 56, so that when the elongate half members 12 and 14 meet the adhesive will hold the opposing circular rods 56 together. Although, FIG. 6 and 8 show the circular rods 56 extending from the interior corners 30, 36 of a rectangular cross-sectional portion 18, the circular rods 56 may also extend from opposing surfaces 24, 26 of the circular cross-sectional portions 20.

Another support means is shown in FIGS. 2 and 3 at 60. Cross supports 60 are provided in each of the elongate half members 12 and 14. The cross supports 60 are particularly beneficial at transitional points of the post 10 where a smaller cross-sectional portion of the post 10 is adjacent to a larger cross-sectional portion of the post. The cross supports 60 are positioned in the circular cross-sectional portion 20 and provide added material strength to an otherwise weak area.

The cross supports 60 are integrally molded to the interiors 24 and 26 of the circular cross-sectional portions 20 and extend outwardly therefrom, so that when the elongate half members 12 and 14 are joined, the cross supports 60 meet within the interior of the post 10. Adjacent to the cross supports 60 in the portion of the post 10 having a greater cross-sectional area, it is preferred to include additional lateral and vertical flanges or shelves 62 and 64 extending from the inner surfaces and further communicate with the cross supports 60. The lateral and vertical shelves 62, 64 respectively provide added support to the post at the transitional portions of the post 10.

Each elongated half member 12 and 14 is integrally molded as a unitary body including all of the support means therein. Adhesive material may be applied to the circular rods 56 and the exposed edges 32 and 38 which when joined together form the seam 16. When the two elongated half members 12 and 14 are joined, a combination of the adhesive and intersection of planar shelves 28, 34 and 40, 48 provide a post without a center metal rod that is durable, weatherproof, inexpensive to manufacture, and easily assembled whether at the manufacturing site or on site.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A post comprising:

a column structure having a hollow interior, said column structure having a first half member and a second half member, each member made from moldable material and connectable to each other for forming the column structure, wherein each half member has integrally formed supports extending therefrom into the hollow interior:

wherein the column structure has an axial length and at least one rectangular cross-sectional portion, wherein said first and second half members are connectable along the diagonal of the rectangular cross-sectional portion; and wherein the first half member and second half member each have interior corners in the rectangular cross-sectional portion and each member has a corresponding support extending from the interior corner for mating in the center of the hollow interior.

2. The post of claim 1, wherein the support from one half member overlaps the support of the other half member when both half members are joined together.

3. The post of claim 1, wherein the column structure has at least one circular cross-sectional portion and said circular cross-sectional portion has a cross support therein adjacent to at least one of the rectangular cross-sectional portion.

4. The post of claim 2, wherein the support further includes a rod extending from an interior surface of each half members and positioned in each half member so that the rods meet when both half members are joined together.

5. The post of claim 1, wherein at least a portion of the column structure has a longitudinally extending support in the hollow interior, wherein portions of the longitudinally extending support are integrally molded to one of the first and second half members, the longitudinally extending support includes a pair of vertical shelves extending from and centrally located in the half members and a single vertical shelf extending from and centrally located in the other half member, the pair of vertical shelves are spaced from each other and positioned so that the single vertical shelf is snugly disposed between the pair of vertical shelves to prevent lateral movement of the post and wherein the support further includes a rod extending from an interior surface of each half members and positioned in each half member so that the rods meet when both half members are joined together.

6. A post comprising:

a column structure having a hollow interior, said column structure having a first half member and a second half member, each member made from moldable material and connectable to each other for forming the column structure, wherein each half member has integrally formed supports extending therefrom into the hollow interior;

wherein the column structure has an axial length and at least one rectangular cross-sectional portion, wherein said first and second half members are connectable along the diagonal of the rectangular cross-sectional portion; and wherein the first half member has a first interior corner in the rectangular cross-sectional portion and said first interior corner has a first planar extension and an adjacent second planar extension extending therefrom.

7. The post of claim 6, wherein the second half member has a second interior corner in the rectangular cross-sectional portion and said second interior corner has a third planar extension positioned along the axial length for disposition between the first and second planar extensions when the first and second half members are connected.

8. A post comprising:

a column structure having a hollow interior, said column structure having a first half member and a second half member, each member made from moldable material and connectable to each other for forming the column structure wherein each half member has integrally formed supports extending therefrom into the hollow interior, wherein at least a portion of the column structure has a longitudinally extending support in the hollow interior, wherein portions of the longitudinally extending support are integrally molded to the first and second half members the longitudinally extending support including a pair of vertical shelves extending from and centrally located in one of the half members and a single vertical shelf extending from and centrally located in the other half member, the pair of vertical shelves are spaced from each other and positioned for snugly receiving the single vertical shelf therebetween for preventing lateral movement of the post.

9. The post of claim 8, further comprising a plurality of laterally extending supports connected to the longitudinally extending support.

10. The post of claim 8, wherein the support further includes a rod extending from an interior surface of each half members and positioned in each half member so that the rods meet when both half members are joined together.

* * * * *